US006585875B1

(12) United States Patent
Ryabkov

(10) Patent No.: US 6,585,875 B1
(45) Date of Patent: Jul. 1, 2003

(54) PROCESS AND APPARATUS FOR CLEANING AND/OR COATING METAL SURFACES USING ELECTRO-PLASMA TECHNOLOGY

(75) Inventor: Danila Vitalievich Ryabkov, Moscow (RU)

(73) Assignee: CAP Technologies, LLC, Baton Rouge, LA (US)

( * ) Notice: Subject to any disclaimer, the term of this patent is extended or adjusted under 35 U.S.C. 154(b) by 0 days.

(21) Appl. No.: 10/031,978

(22) PCT Filed: Jul. 28, 2000

(86) PCT No.: PCT/GB00/02917

§ 371 (c)(1),
(2), (4) Date: Jan. 25, 2002

(87) PCT Pub. No.: WO01/09410

PCT Pub. Date: Feb. 8, 2001

(30) Foreign Application Priority Data

Jul. 30, 1999 (RU) ..... 99116537

(51) Int. Cl.[7] ..... C25D 5/00; C25F 1/00

(52) U.S. Cl. ..... 205/87; 204/164; 204/206; 204/224 R; 204/232; 204/237; 204/239; 204/241; 204/269; 204/275.1; 205/88; 205/98; 205/118; 205/138; 205/148; 205/705; 205/722

(58) Field of Search ..... 205/80, 87, 88, 205/98, 102, 118, 138, 148, 705, 710, 722; 204/164, 224 R, 232, 237, 239, 241, 202, 203, 206, 207, 269, 274, 275.1, 284

(56) References Cited

U.S. PATENT DOCUMENTS 4,214,952 A * 7/1980 Sato et al. ..... 204/14 R
4,360,410 A * 11/1982 Fletcher et al. ..... 205/148
5,700,366 A 12/1997 Steblianko et al.
6,368,467 B1 4/2002 Andrews et al.

FOREIGN PATENT DOCUMENTS

| | | |
|---|---|---|
| EP | 0 955 393 | 11/1999 |
| WO | WO 98 32892 | 7/1998 |
| WO | WO 01/09410 | 2/2001 |

OTHER PUBLICATIONS

International Preliminary Examination Report, International Application No. PCT/GB00/02917, filed Jul. 28, 2000, Applicant: Danila Vitalievich Ryabkov, no publication date.

* cited by examiner

*Primary Examiner*—Roy King
*Assistant Examiner*—William T. Leader
(74) *Attorney, Agent, or Firm*—Brooks & Kushman P.C.

(57) ABSTRACT

A process for cleaning an electrically conducting surface (3) by arranging for the surface to form the cathode of an electrolytic cell in which the anode (1) is maintained at a DC voltage in excess of 30V and an electrical arc discharge (electro-plasma) is established at the surface of the workpiece by suitable adjustment of the operating parameters, characterized in that the working gap between the anode and the cathode is filled with an electrically conductive medium consisting of a foam (9) comprising a gas/vapor phase and a liquid phase. The process can be adapted for simultaneously coating the metal surface by including ions of the species required to form the coating in the electrically conductive medium. Apparatus for carrying out the process is also disclosed and, in particular, an anode assembly (1) which comprises a perforated anode plate (2) which is in communication with a chamber (4) adapted to receive a flow of a liquid electrolyte, means to supply the liquid electrolyte to the chamber, and means (7) to convert the liquid electrolyte received in the chamber into a foam.

18 Claims, 4 Drawing Sheets

PROCESS AND APPARATUS FOR CLEANING AND/OR COATING METAL SURFACES USING ELECTRO-PLASMA TECHNOLOGY

The present invention relates to an improved process and apparatus for cleaning and/or coating metal surfaces using electro-plasma technology.

Metals, notably, steel in its many forms, usually need to be cleaned and/or protected from corrosion before being put to their final use. As produced, steel normally has a film of mill-scale (black oxide) on its surface which is not uniformly adherent and renders the underlying material liable to galvanic corrosion. The mill-scale must therefore be removed before the steel can be painted, coated or metallised (e.g. with zinc). The metal may also have other forms of contamination (known in the industry as "soil") on its surface including rust, oil or grease, pigmented drawing compounds, chips and cutting fluid, and polishing and buffing compounds. All of these must normally be removed. Even stainless steel may have an excess of mixed oxide on its surface which needs removal before subsequent use.

Traditional methods of cleaning metal surfaces include acid pickling (which is increasingly unacceptable because of the cost and environmental problems caused by the disposal of the spent acid); abrasive blasting; wet or dry tumbling; brushing; salt-bath descaling; alkaline descaling and acid cleaning. A multi-stage cleaning operation might, for example, involve (i) burning-off or solvent-removal of organic materials, (ii) sand- or shot-blasting to remove mill-scale and rust, and (iii) electrolytic cleaning as a final surface preparation. If the cleaned surface is to be given anti-corrosion protection by metallising, painting or plastic coating, this must normally be done quickly to prevent renewed surface oxidation. Multi-stage treatment is effective but costly, both in terms of energy consumption and process time. Many of the conventional treatments are also environmentally undesirable.

Electrolytic methods of cleaning metal surfaces are frequently incorporated into processing lines such as those for galvanising and plating steel strip and sheet. Common coatings include zinc, zinc alloy, tin, copper, nickel and chromium. Stand-alone electrolytic cleaning lines are also used to feed multiple downstream operations. Electrolytic cleaning (or "electro-cleaning") normally involves the use of an alkaline cleaning solution which forms the electrolyte while the workpiece may be either the anode or the cathode of the electrolytic cell, or else the polarity may be alternated. Such processes generally operate at low voltage (typically 3 to 12 Volts) and current densities from 1 to 15 Amps/dm$^2$. Energy consumptions thus range, from about 0.01 to 0.5 kWh/m$^2$. Soil removal is effected by the generation of gas bubbles which lift the contaminant from the surface. When the surface of the workpiece is the cathode, the surface may not only be cleaned but also "activated", thereby giving any subsequent coating an improved adhesion. Electrolytic cleaning is not normally practicable for removing heavy scale, and this is done in a separate operation such as acid pickling and/or abrasive-blasting.

Conventional electrolytic cleaning and plating processes operate in a low-voltage regime in which the electrical current increases monotonically with the applied voltage. Under some conditions, as the voltage is raised, a point is reached at which instability occurs and the current begins to decrease with increasing voltage. The unstable regime marks the onset of electrical discharges at the surface of one or other of the electrodes. These discharges ("micro-arcs" or "micro-plasmas") occur across any suitable non-conducting layer present on the surface, such as a layer of gas or vapour. This is because the potential gradient in such regions is very high.

PRIOR ART

GB-A-1399710 teaches that a metal surface can be cleaned electrolytically without over-heating and without excessive energy consumption if the process is operated in a regime just beyond the unstable region, the "unstable region" being defined as one in which the current decreases with increasing voltage. By moving to slightly higher voltages, where the current again increases with increasing voltage and a continuous film of gas/vapour is established over the treated surface, effective cleaning is obtained. However, the energy consumption of this process is high (10 to 30 kWh/m$^2$) as compared to the energy consumption for acid pickling (0.4 to 1.8 kWh/m$^2$).

SU-A-1599446 describes a high-voltage electrolytic spark-erosion cleaning process for welding rods which uses extremely high current densities, of the order of 1000 A/dm$^2$, in a phosphoric acid solution.

SU-A-1244216 describes a micro-arc cleaning treatment for machine parts which operates at 100 to 350 V using an anodic treatment. No particular method of electrolyte handling is taught.

Other electrolytic cleaning methods have been described in GB-A-1306337 where a spark-erosion stage is used in combination with a separate chemical or electro-chemical cleaning step to remove oxide scale; in U.S. Pat. No. 5,232,563 where contaminants are removed at low voltages from 1.5 to 2V from semi-conductor wafers by the production of gas bubbles on the wafer surface which lift off contaminants; in EP-A-0657564, in which it is taught that normal low-voltage electrolytic cleaning is ineffective in removing grease, but that electrolytically oxidisable metals such as aluminum may be successfully degreased under high voltage (micro-arc) conditions by acid anodisation.

The use of jets of electrolyte situated near the electrodes in electrolytic cleaning baths to create high speed turbulent flow in the cleaning zone is taught for example in JP-A-08003797 and DE-A-4031234.

The electrolytic cleaning of radioactively contaminated objects using a single jet of electrolyte without overall immersion of the object, is taught in EP-A-0037190. The cleaned object is anodic and the voltage used is between 30 to 50V. Short times of treatment of the order of 1 sec are recommended to avoid erosion of the surface and complete removal of oxide is held to be undesirable. Non-immersion is also taught in CA-A-1165271 where the electrolyte is pumped or poured through a box-shaped anode with an array of holes in its base. The purpose of this arrangement is to allow a metal strip to be electro-plated on one side only and specifically to avoid the use of a consumable anode.

DE-A-3715454 describes the cleaning of wires by means of a bipolar electrolytic treatment by passing the wire through a first chamber in which the wire is cathodic and a second chamber in which the wire is anodic. In the second chamber, a plasma layer is formed at the anodic surface of the wire by ionisation of a gas layer which contains oxygen. The wire is immersed in the electrolyte throughout its treatment.

EP-A-0406417 describes a continuous process for drawing copper wire from copper rod in which the rod is plasma cleaned before the drawing operation. The "plasmatron" housing is the anode and the wire is also surrounded by an inner co-axial anode in the form of a perforated U-shaped sleeve. In order to initiate plasma production the voltage is maintained at a low but unspecified value, the electrolyte level above the immersed wire is lowered, and the flow-rate decreased in order to stimulate the onset of a discharge at the wire surface.

Whilst low voltage electrolytic cleaning is widely used to prepare metal surfaces for electro-plating or other coating treatments, it cannot handle thick oxide deposits such as mill-scale without an unacceptably high expenditure of energy. Such electrolytic cleaning processes must normally be used, therefore, in conjunction with other cleaning procedures in a multi-stage operation.

WO-A-97/35052 describes an electrolytic process for cleaning electrically conducting surfaces using an electro-plasma (arc discharge) in which a liquid electrolyte flows through one or more holes in an anode held at a high DC voltage and impinges on the workpiece (the cathode) thus providing an electrically conductive path. The system is operated in a regime in which the electrical current decreases or remains substantially constant with increase in the voltage applied between the anode and the cathode and in a regime in which discrete bubbles of gas and/or vapour are present on the surface of the workpiece during treatment.

WO-A-97/35051 describes an electrolytic process for cleaning and coating electrically conducting surfaces which is similar to the process as described in WO-A-97/35052 except that the anode comprises a metal for metal-coating of the surface of the workpiece.

In operating the processes of WO-A-97/35051 and WO-A-97/35052 an arc discharge or electro-plasma is formed on the surface of the workpiece and is established within the bubble layer. The plasma has the effect of rapidly removing mill-scale and other contaminants from the surface of the work-piece, leaving a clean metal surface which may also be passivated (resistant to further oxidation).

If, additionally, the anode is constructed from a non-inert material, such as a non-refractory metal, then metal atoms are transferred from the anode to the cathode, providing a metal coating on the cleaned surface.

Coating may also be achieved under the regime of operation described above by using an inert anode and an electrolyte containing ions of the metal to be coated as described in WO-A-99/15714. In this case the process becomes a special form of electroplating, but because it occurs at high voltage in the presence of an arc discharge the plating is faster than normal electroplating and the coating has better adhesion to the substrate metal.

WO-A-98/32892 describes a process which operates essentially in the manner described above but uses a conductive gas/vapour mixture as the conductive medium. This gas/vapour mixture is generated within a two- or multi-chambered anode before being ejected into the working gap through holes in the anode. The gas/vapour mixture is generated by heating an aqueous electrolyte within the anode chambers to boiling point or above, and the anode chambers may be heated either by the main electric current or by independent electrical heaters.

We have now developed an improved process in which an electro-plasma (arc discharge) is employed to clean and/or to apply a metal coating to an electrically conductive surface, for example, steel, in which the electrically conductive pathway is provided by a foaming electrolyte which fills the space between the anode and the cathode and provides advantages with respect to lower power consumption, more uniform surface treatment and greater latitude in the size of the gap between anode and workpiece.

SUMMARY OF THE INVENTION

Accordingly in a first aspect the present invention provides a process for cleaning an electrically conducting surface by arranging for the surface to form the cathode of an electrolytic cell in which the anode is maintained at a DC voltage in excess of 30V and an electrical arc discharge (electro-plasma) is established at the surface of the workpiece by suitable adjustment of the operating parameters, characterised in that the working gap between the anode and the cathode is filled with an electrically conductive medium consisting of a foam comprising a gas/vapour phase and a liquid phase.

In a second aspect the present invention provides a process for coating an electrically conducting surface by arranging for the surface to form the cathode of an electrolyte cell in which the anode is maintained at a DC voltage in excess of 30V and an electrical arc discharge (electro-plasma) is established at the surface of the workpiece by suitable adjustment of the operating parameters, characterised in that the working gap between the anode and the cathode is filled with an electrically conductive medium containing positive ions of the (one or more) species required to form the coating and consisting of a foam comprising a gas/vapour phase and a liquid phase.

In a further aspect the present invention provides an anode assembly which comprises a perforated anode plate which is in communication with a chamber adapted to receive a flow of liquid electrolyte, means to supply the liquid electrolyte to the said chamber and means to convert the liquid electrolyte received in the said chamber into a foam.

In a still further aspect the present invention provides apparats for cleaning and/or coating an electrically conducting surface which comprises (i) a sealed treatment zone having one or more anode assemblies as described above suitably disposed with respect to the surface or surfaces to be treated;

(ii) means to continuously move a workpiece to be treated through the treatment zone between the anode assemblies, (iii) means to open and close the treatment zone, and (iv) means to control the supply of a foam to and removal of the foam from the treatment zone.

DESCRIPTION OF THE INVENTION

The foam may suitably be produced by boiling an aqueous electrolyte, although other methods of foam production may also be used. If the foamed electrolyte contains only ions of metals that react with water, such as sodium or potassium, the workpiece is cleaned. If other metal ions are present they will, additionally, be deposited to form a coating on the cleaned workpiece.

The operating parameters that can be adjusted to provide the necessary conditions for the establishment of an electro-plasma include; the voltage; the chemical composition of the foam; the density of the foam; the temperature of the foam; the rate at which the foam is supplied to the working gap; and the width of the working gap (the distance between the anode and the cathode).

This invention also provides for an anode assembly containing one or more heated chambers in which an electrolyte may be converted into a foam before being injected into the working gap, together with means for removing the foam from the working gap, filtering, rejuvenating and recirculating spent foam.

This invention further provides for the containment of the foam within the working gap by means of an enclosure through which the workpiece can move without significant leakage of foam.

The present invention represents an improvement on the prior art methods of cleaning and/or coating in that the conductive medium between the anode and cathode is neither a liquid electrolyte nor a gas/vapour mixture, but an electrically conductive foam which fills the entire working gap. Generally, the term "foam" refers to a medium containing at least 20% by volume, preferably 30% by volume of gas and/or vapour in the form of bubbles or cells, the remainder of the medium being liquid. More preferably at least 50% by volume of the foam is gas and/or vapour in the form of bubbles or cells. The foam used in the present invention is generally formed from an aqueous electrolyte.

Such a foam may conveniently be formed by boiling an aqueous electrolyte such as a solution of metal salts in water. Foaming agents and stabilisers may be added to optimise the properties of the foam, in terms of foam density, and bubble or cell size, for example.

However, other methods of foam production may also be employed, such as the incorporation in an electrolyte of thermally-activated blowing agents; the release of pressure from a liquid electrolyte super-saturated with a volatile substance (as when a bottle of champagne is shaken and opened); the mechanical injection of a liquid electrolyte with steam or another vapour or gas; the mechanical 'whipping' of a relatively viscous electrolyte; or the combination of two liquid streams which react together chemically to produce a gas causing the mixture to 'blow' into a foam; or other means known in the art for creating liquid foams.

The use of a foam as the conductive medium has the following advantages over liquid electrolytes.

a) The foam, by virtue of its gas/vapour content, has a lower conductivity than the corresponding liquid electrolyte. This reduces the current flow during cleaning/coating and thus reduces power consumption and improves the economics of the process.

b) Because the bubble size and overall gas/vapour content of the foam may be varied, it provides an additional means of control over the power consumption of the process and the intensity of the process. This in turn permits control over the smoothness or roughness (the topography or profile) of the cleaned or coated surface.

c) Since the foam fills the entire working gap, electrical conduction involves the whole surface of the anode and the whole surface of the work-piece under the anode. This contrasts with the use of a liquid electrolyte where independent streams of electrolyte impinge on the work-piece. The use of foam thus improves the uniformity of the process, both as regards the treated surface and (where applicable) the erosion of any sacrificial anode. The current flow is also more uniform being unaffected by the interruption of liquid streams which can occur when a liquid electrolyte is used and, for example, anode holes become blocked.

d) When liquid streams impinge on the work-piece there is a limit to the size of the working gap that can be used in practice because the liquid streams break up and destroy the conductive pathway. This does not occur when foam fills the working gap uniformly, so that both smaller and larger working gaps can be used. This has great practical importance in, for example, the on-line cleaning of steel sheet where it is not practicable to maintain a uniform working gap. The greater tolerance of the foam method towards variations in the working gap provides a practical advantage under such conditions.

The advantages listed above are not intended to be exhaustive but to illustrate that the use of foam rather than liquid or gas/vapour as the conductive medium represents a genuine advance in the technology of electro-plasma cleaning and coating technology.

The foam may conveniently be produced by injecting an aqueous electrolyte into the working gap through holes in a heated anode so that the electrolyte boils and foams in the process. Preferably, the electrolyte is heated to its boiling point before passing into the working gap.

This advance foaming may be suitably be achieved by arranging for the anode assembly to contain one or more heated chambers through which the electrolyte passes in succession, the chambers being separated by perforated plates to allow passage of the electrolyte from one chamber to another and finally into the working gap.

The chambers themselves may be heated by the operating current passing through the anode but preferably by one or more independent heaters situated within the chamber(s).

In an alternative embodiment of the invention, a voltage is applied to the anode and an electrolyte is injected into the working gap at any convenient point other than through holes in the anode. The electrolyte is converted into foam in the working gap by being caused to boil by its own resistive heating (or otherwise) and contact with the hot surfaces of anode and/or cathode. Preferably, however, the electrolyte is converted into foam by suitable means outside the working gap and then injected thereinto.

Whether the foam is introduced into the working gap through holes in the anode or otherwise, it is necessary to provide means for the used foam to be removed from the working region. If the system is open, this will occur naturally as foam runs off the workpiece into a collecting tank. If the working gap is enclosed, an exhaust port is provided to drain away used foam. In most cases the used foam can be condensed to liquid, cleaned, filtered, rejuvenated (e.g. by adjustment of pH or salt concentration), reheated, and recirculated.

The process of the present invention is operated in a manner such that an electrical arc discharge (electro-plasma) is established at the surface of the workpiece. This is achieved by suitable adjustment of the operating parameters such as the voltage, the inter-electrode separation, the electrolyte flow rate into the working zone (whether in the form of liquid or foam) and the electrolyte temperature. It may also be advantageous to initiate the plasma discharge in an aqueous (non-foam) environment and then to introduce the foamed electrolyte into the working gap. For example, in a closed working chamber (see below) a pool of liquid electrolyte may be allowed to form between the anode and the workpiece (cathode) which provides a conductive bridge for the initiation of the process and the establishment of the desired plasma regime.

A further embodiment of the invention is achieved by arranging for the anode, and the area of the workpiece undergoing treatment, to lie within a sealed enclosure which has the effect of containing the foam. This makes it easier to ensure that the foam fully fills the working gap at all times and allows the foam-injection rate to be reduced. It also allows a pressure somewhat higher than atmospheric pressure to be maintained in the working region. An elevated pressure has the effect of reducing bubble size both in the foam and on the workpiece surface and can produce smoother cleaned or coated surfaces.

Since one important application of the invention is its use in continuous processes, where the workpiece moves continuously through the treatment zone, the enclosure must allow the workpiece to move while maintaining a reasonable seal. This can be achieved by using flexible rubber seals around the moving workpiece.

The cleaning effects achieved by the process of the present invention are believed to occur largely (though not exclusively) through micro-zonal melting of the workpiece surface. Small bubbles of hydrogen and steam form on the cathode and undergo electrical breakdown due to the high potential gradient developed across them. As each bubble undergoes breakdown, a micro-arc forms briefly, raising the temperature of the surface within a micro-region (a region measured in microns) and causing localised melting of the surface. That is, the micro-zonal melting of the surface occurs through microelectric plasma discharges between positive ions in the foam which are concentrated near to the surface of the workpiece and the surface of the workpiece. After the micro-discharge has occurred, the surface rapidly solidifies again.

The process of the present invention may be used in various ways to clean or coat one side or both sides of an article simultaneously by the use of multiple anodes suitably positioned with respect to the workpiece. Any shape or form of workpiece such as sheet, plate, wire, rod, tube, pipe or complex shapes may be treated, using if necessary shaped anode surfaces to provide a reasonably uniform working distance. Both static and moving workpieces may be treated in accordance with the present invention.

The present invention will be further described with reference to FIGS. 1 to 4 of the accompanying drawings, in which:

BRIEF DESCRIPTION OF THE DRAWINGS

Referring to FIG. 1 of the drawings, an anode assembly 1 comprises a perforated anode plate 2 which faces one surface of a workpiece 3 which acts as the cathode. The anode assembly 1 has a first chamber 4 containing liquid electrolyte which is separated from a second chamber 5 containing foam by means of a perforated chamber divider 6 and a heated screen with temperature controller 7. Liquid electrolyte is fed via inlet manifold 8 to the first chamber 4. The liquid electrolyte is heated by means of the heated screen 7 and is caused to boil and foam. The foam which collects in the second chamber 5 passes through the holes in the perforated anode plate 2 to fill the space 9 between the anode plate 2 and the workpiece 3. The workpiece 3 is positioned on rollers 10 so that it can be moved from underneath the anode plate 2 when it has been treated. The rollers 10 also act to earth the system.

Referring to FIG. 2 of the drawings, a system for continuously treating both sides of a moving workpiece is shown. The system operates in the vertical direction. A workpiece 11, which acts as a cathode, is guided in the vertical direction by two sets of rollers 12 and 13 which not only guide the workpiece but also act to earth the system. The workpiece 11 is guided by rollers 12 through flexible rubber seals 14 into a treatment zone which is provided with anode assemblies 15 on either side of the workpiece. The anode assemblies 15 are essentially constructed according to the arrangement as shown in FIG. 1, except that they are positioned vertically. Electrolyte is passed through inlets 16 into the anode assemblies 15 and is caused to foam therein. The foam is injected from the assemblies 15 in the direction as shown into the working gaps 17 on either side of the workpiece. The workpiece is moved during treatment (by reeling or other suitable means) over guiding rollers 13 via rubber seals 18 which contain the foam in the treatment zone whilst the workpiece 11 moves.

FIG. 3 illustrates the characteristic pitted surface of a workpiece treated in accordance with the invention. The surface has a characteristic pitted surface consisting of small craters corresponding to the size of the micro zones which are melted during the cleaning process.

Referring to FIG. 4 of the drawings, the apparatus comprises a workpiece being treated 20, a source of electric power 21, a reaction chamber 22, a vessel for electrolyte 23 and a supply pipeline 24. The reaction chamber 22 is connected to the positive pole of the electric power source 21 and is constructed with chambers 25 for the preparation of the foam. The chambers 25 have openings 26 in the base 27. The openings 26 are in communication with treatment sections 28. The apparatus includes electrically insulated rollers 29 which close the treatment section 28, appliances 30 for pressure discharge through the by-passes equipped with valves into the vessel 23, earthed metal rollers 31, an insulating jacket 32, a protective chamber 33, and a discharge pipeline 34. The workpiece under treatment 20 is connected to the negative pole of the electric power source 21 and is drawn through the treatment zone 28. Electrolyte is supplied from vessel 23 and supply pipeline 24, equipped with a pump (not shown), to chambers 25 of the reaction chamber 22. Foam is prepared from the electrolyte which then passes through openings 26 in the plate 27 into the treatment zone 28, where surface modification of the workpiece takes place by means of microzonal re-melting of the surface layer through the application of microelectricplasma discharges between the ions concentrated near the surface of the workpiece 20 under treatment. The foam is retained within the treatment zone 28 by means of a closure formed by electrically insulated rollers 29. Excess foam is drained away and the pressure is discharged through openings 30 via by-passes, equipped with valves, into the electrolyte vessel 23. In order to connect the negative pole of the power source 21 to the workpiece under treatment 20 earthed metal rollers 31 are used. In order to electrically insulate the reaction chamber 22 it is placed in an insulating jacket 32. The reaction chamber 22 with the jacket 32 is placed in a protective chamber 33 to protect against electrolyte and foam leakage and to assist in improving recycling of the electrolyte. The electrolyte that accumulates in the protective chamber 33 is drained away into the vessel 23 via the discharge pipeline 34.

The present invention will be further described with reference to the following Examples.

EXAMPLE 1

Figure 2:
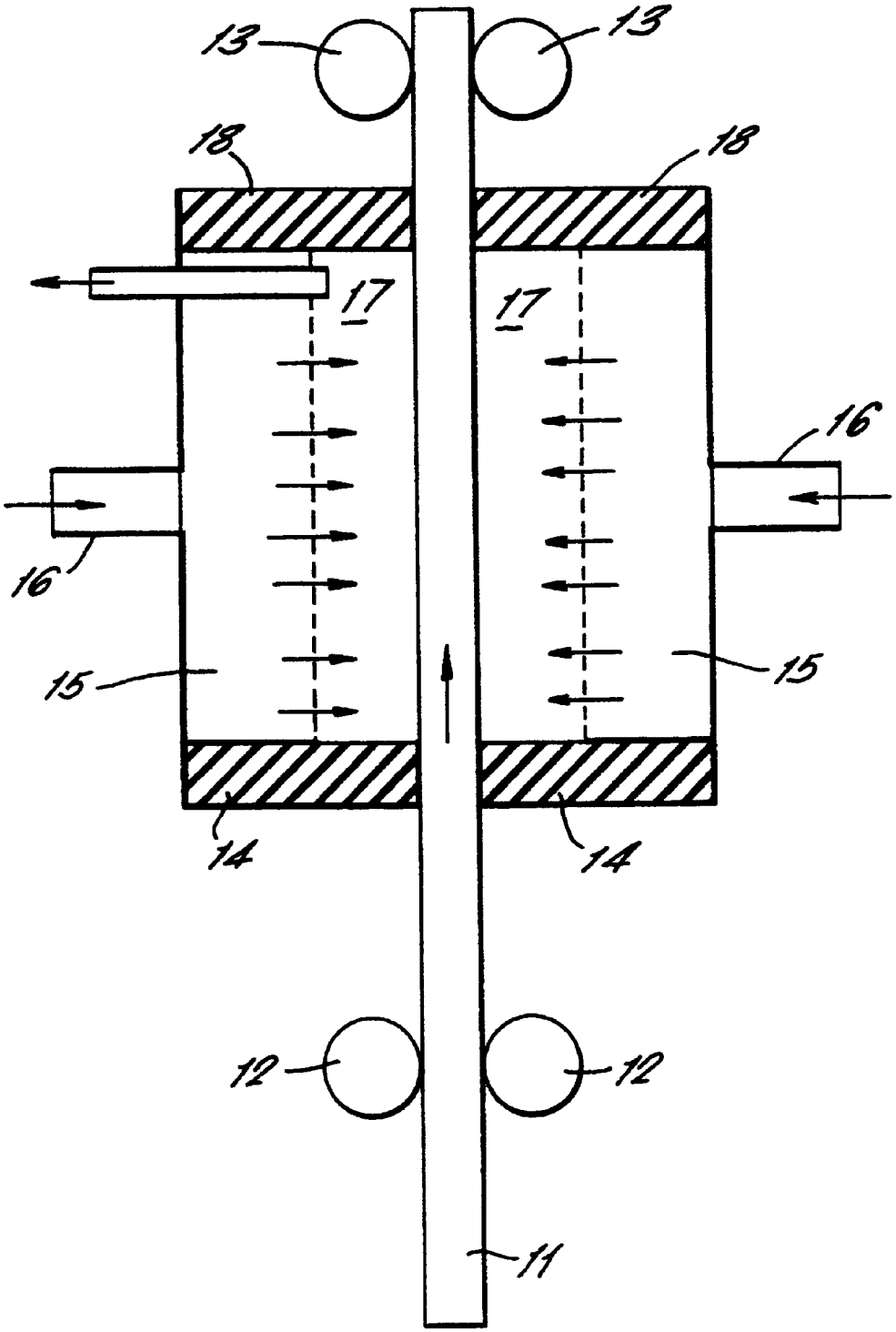
FIG. 2 illustrates the continuous operation of the process of the present invention.
Figure 3:
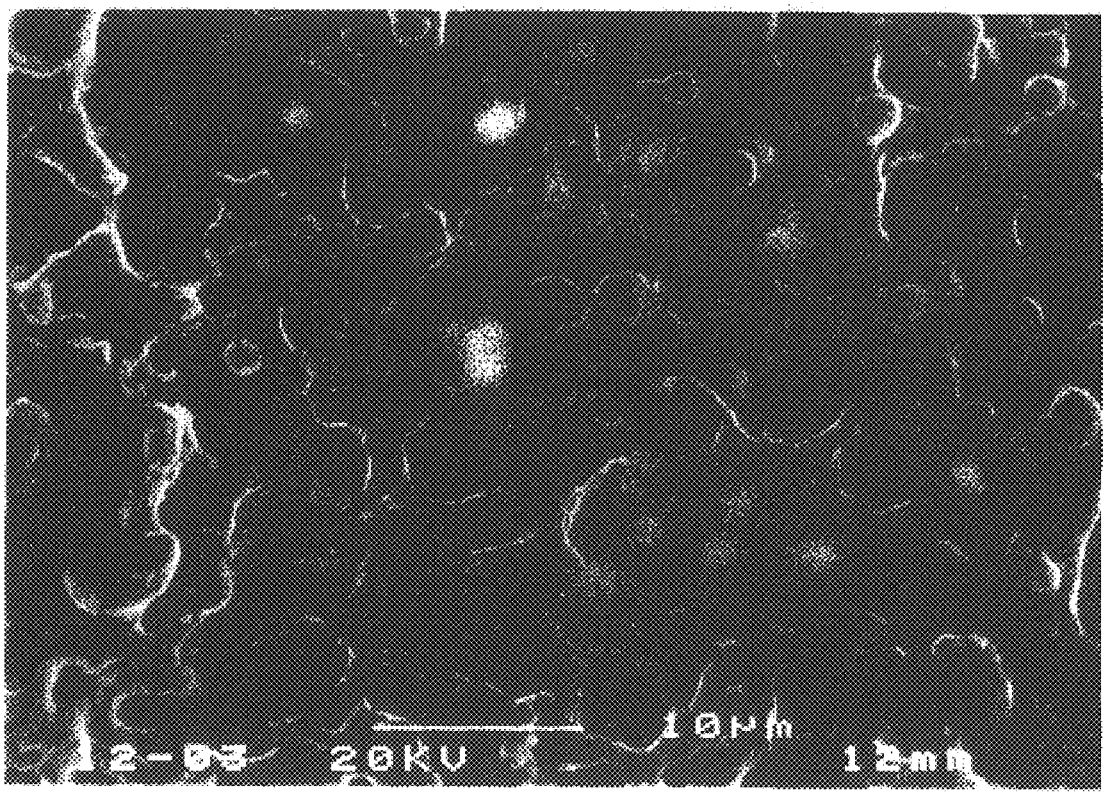
FIG. 3 illustrates the surface of a workpiece treated according to the process of the invention.
Figure 4:
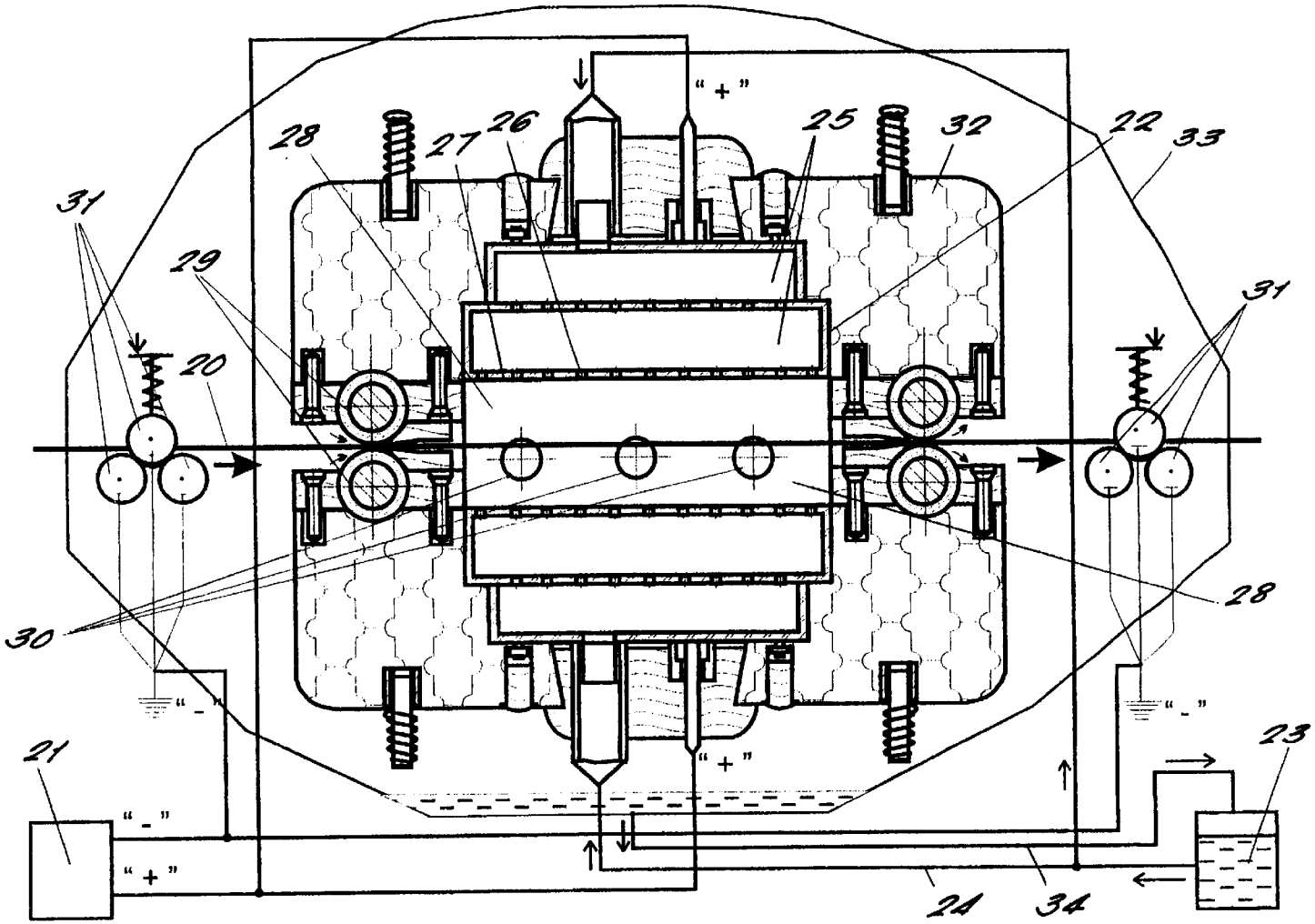
FIG. 4 illustrates a further embodiment of the continuous operation of the process of the invention.

A continuous strip of low-carbon steel covered on both sides with a layer of black mill-scale was passed vertically through the closed apparatus shown in FIG. 2 at a steady speed of about 1 cm/sec. The width of the strip was 10 cm and the working area of each anode was 10 cm×10 cm.

An electrolyte consisting of a 10% solution of sodium bicarbonate in water was pre-heated to 90° C. and caused to flow through holes in the anode plates situated on either side of the strip into a working gap (anode-to-workpiece distance) of 10 mm.

Initially the electrolyte pooled at the bottom of the chamber, being partially retained by the rubber seals. A DC voltage was applied to the anode (the strip being earthed) and automatically limited to about 10V on account of the high current flow of above 40 amps.

The flow-rate of the electrolyte was gradually decreased until resistive heating of the pooled liquid electrolyte at the bottom of the chamber caused it to boil and foam, filling the working gaps on either side of the strip with foam from top to bottom.

At the same time the current flow decreased abruptly and (under the influence of the intelligent power-supply) the DC voltage automatically rose to a pre-set maximum value of 150V. Plasma formed on the surfaces of the steel strip (visibility being provided by Plexiglass side-windows in the chamber).

The process stabilised in this condition, with a current flow of around 20 amps through each anode. Thus the energy consumption was around 30 watts/cm$^2$ of treated surface. This compared with an energy consumption of around 50 watts/cm$^2$ for a process carried out in an apparatus such as that illustrated in FIG. 1 but using streams of liquid electrolyte without foaming.

The surface of the steel strip was cleaned on both sides, the mill-scale being removed completely, and was washed free of electrolyte contamination using clean hot water.

The surface consisted of a thin layer (a few microns thick) of alpha iron from which carbon had been removed, creating a passified (oxidation-resistant) surface.

EXAMPLE 2

Figure 1:
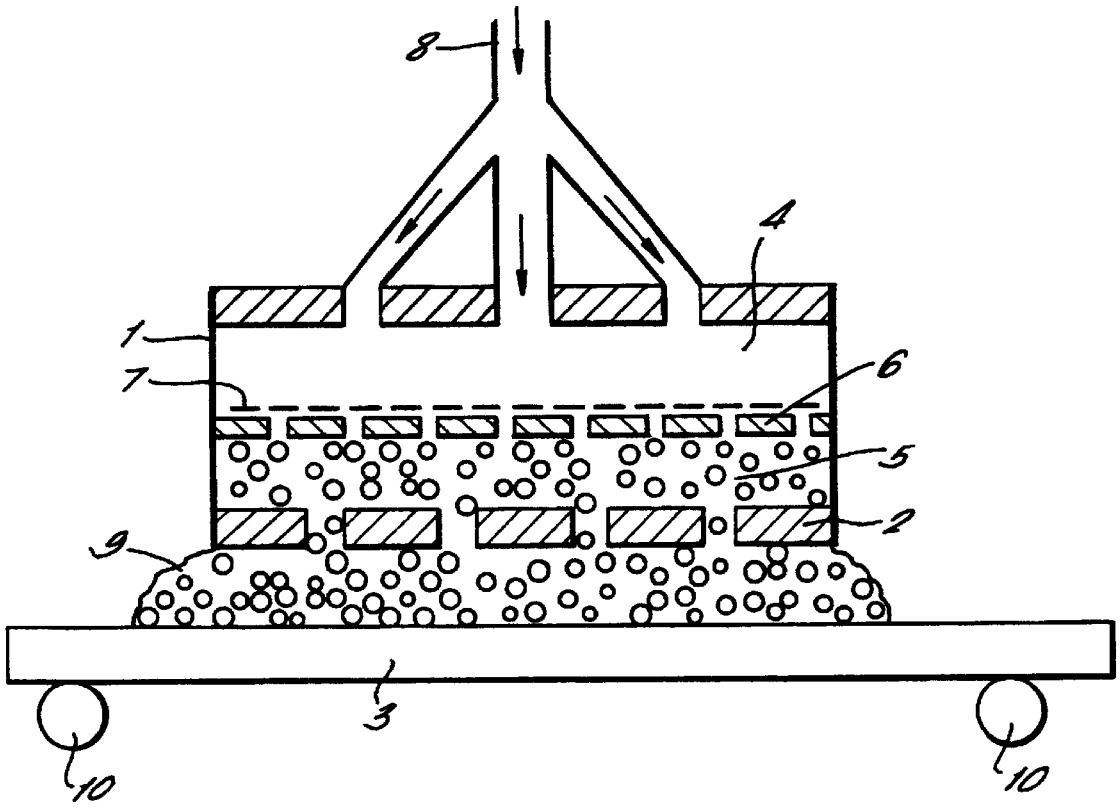
FIG. 1 illustrates schematically an anode assembly for the generation of foam.

A continuous low-carbon steel strip as in Example 1 was passed horizontally through an apparatus as shown in FIG. 1 at a speed of around 1 cm/sec. An electrolyte as described in example 1 was caused to flow through holes in the anode plate into the working gap above the strip, which was set at 10 mm. A DC voltage of 200V is applied to the anode. Initially the electrolyte consisted of liquid streams, and a stable plasma was established on the surface of the strip by gradually reducing the flow-rate of the electrolyte.

The internal heater in the anode assembly was turned on, raising the temperature of the electrolyte and causing it to fill the working gap substantially in the form of a foam. While the process was running, the working gap was increased to 20 mm without destroying the plasma or disrupting the cleaning process.

Without a foaming electrolyte (that is, using only liquid electrolyte streams) such an increase in the working gap causes the plasma to be quenched. Thus larger working distances can be used with a foaming electrolyte than with a liquid electrolyte.

The surface of the steel strip was cleaned on one side, the mill-scale being removed completely.

EXAMPLE 3

A stationary copper sheet was cleaned of oxide in an apparatus as shown in FIG. 2. The process was essentially as described in Example 1 except that the electrolyte consisted of a saturated solution of sodium chloride heated to 90° C. In this case, however, the electrolyte exhaust tube was restricted by a clamp in order to generate a slightly elevated pressure in the enclosed working chamber, estimated at 112 kPa.

The copper sheet was cleaned and the resulting surface was smoother than that produced using a liquid electrolyte, at atmospheric pressure and without foaming, in an apparatus such as that shown in FIG. 1.

EXAMPLE 4

A 3 mm diameter high-carbon steel wire, with "patenting" scale was cleaned in an apparatus similar to that in FIG. 2 hereof but disposed horizontally, with the work-piece (wire) also running horizontally.

To create "patenting" scale, an as-drawn wire was heated above 900° C. and then quenched in molten lead at 510° C. The patenting process produced a thin, tightly adhered scale that was mostly $Fe_3O_4$ and was not soluble in sulphuric acid. This treatment, therefore, produces a much more tenacious scale than normal and presents a particular challenge to any process designed to remove it.

The wire was cleaned of scale, statically, under the following conditions.

| | |
|---|---|
| Electrolyte temperature: | 90° C.(liquid temperature before foaming) |
| Electrolyte composition: | 10% aqueous $NaHCO_3$ (pH 7.64) |
| Electrolyte flow rate: | 0.25 g/min |
| Working chamber pressure: | 17.2 to 62.0 kPa (2.5 psi to 9.0 psi) |

The two anodes were made from stainless steel. The anode plate was 53 mm and 228 mm long, giving a working surface area of around 12000 mm$^2$. The distance from each anode-face to the wire was 22.0 mm.

Electrolyte entered the working chamber through a 6.0 mm opening at the bottom centre of the working chamber. A single 6.0 mm outlet was provided in the upper left portion of the work space. This exit had a pressure gauge and control valve.

In the bottom of the working chamber were situated two 500 watt ceramic heaters which were used to boil the (initially) liquid electrolyte, so as to fill the working chamber with foam. A sight-glass was used to ascertain the liquid level above the heaters and below the wire.

Plasma was started at 140V DC by adjusting the electrolyte flow-rate. Foaming was commenced. Operating voltage was then reduced in 10 volt increments until the voltage reached 80V, when the plasma extinguished. The current ranged from 5 amps at 140V up to a maximum of 13 amps at 80V. The process worked equally well at the elevated voltage as well as at the lower voltage. At elevated voltage the pressure in the working chamber was greater than at lower voltage.

The wire was originally covered by a smooth, even black scale. After exposure to the plasma for approximately one second the wire exhibited a clean, matt white surface and all scale had been removed.

EXAMPLE 5

A low-carbon steel strip as in Example 1 was coated on both sides with zinc in the apparatus shown in FIG. 2. The strip was held stationary and treated for a period of 10 seconds. The electrolyte was an 80% saturated solution of zinc sulphate in water and the operating conditions were substantially as described in Example 1. The resulting coated specimen was subjected to examination using SEM to look at a cross-section, and EDAX of the coated surface.

The zinc coating was solid and varied from 4 to 7 microns in thickness. The coated surface gave a clear diffraction pattern containing only the peaks of alpha iron and zinc (no signs of zinc oxide were found). The metallurgical composition of the zinc coating (in mass %) was estimated at: Zinc 96%; Fe 4.0%.

What is claimed is:

1. A process having operating parameters for treating an electrically conducting surface on a workpiece by cleaning or coating the surface, comprising the steps of:

deploying the electrically conducting surface of the workpiece to form a cathode in an electrolytic cell;

establishing a DC voltage between the cathode and an anode in excess of 30V;

forming a working gap between the anode and the cathode, and establishing a seal around the working gap to form a sealed treatment zone;

delivering into the working gap an electrically conductive medium selected from the group consisting of: (A) an aqueous electrolyte from which a foam is created; (B) a foam; and a mixture of components (A) and (B), so that electrically conductive medium consisting of a foam comprising a gas/vapor phase and a liquid phase fills the working gap;

adjusting the operating parameters so that an electroplasma discharge is created between the cathode and positive ions in the electrically conductive medium which are concentrated near the electrically conducting surface of the workpiece, thereby causing micro-zonal melting of the surface; and removing foam from the working gap.

2. The process of claim 1, wherein the positive ions include one or more species of positive ions that form a coating on the workpiece.

3. A process as claimed in claim 1, in which the positive ions are derived from one or more sacrificial anodes.

4. A process as claimed in claim 1, in which the positive ions derived from at least one of a group consisting of one or more sacrificial anodes and the electrically conductive medium.

5. A process as claimed in claim 1, in which the foam is introduced into the working gap at least partially through the anode.

6. A process as claimed in claim 1, in which the foam is introduced into the working gap other than through the anode.

7. A process as claimed in claim 1, in which the aqueous electrolyte is heated.

8. A process as claimed in claim 1, wherein the foam is generated by mechanical means.

9. A process as claimed in claim 1, in which foam formation, properties and stability are controlled by mixing with the electrically conductive medium an additive selected from the group consisting of a foaming agent, a surfactant, a viscosity modifier and mixtures thereof.

10. A process as claimed in claim 1, in which the anode comprises an assembly having one or more heated chambers in which the foam is generated and wherein the foam is injected into the working gap through the anode.

11. A process as claimed in claim 1, in which pressure within the working gap is maintained at or above atmospheric pressure.

12. An apparatus for cleaning or coating an electrically conducting surface of a workpiece, the apparatus including:

a chamber comprising one or more porous chamber dividers that separate the chamber into multiple sections, one section being adapted to receive an aqueous electrolyte, another section comprising a perforated anode plate which forms an outer wall of the chamber;

means for converting the aqueous electrolyte into a foam;

a heated screen located in the one section of the chamber which adds thermal energy to the aqueous electrolyte so that the temperature thereof can be controlled and the aqueous electrolyte is converted into the foam; and means for sealing the region of a working gap formed between the anode plate and the surface of the workpiece, thereby forming a sealed treatment zone adapted to be filled with foam delivered through the perforated anode plate.

13. The apparatus of claim 12, further comprising:

means for supplying the aqueous electrolyte to the one or more chambers; and means for continuously moving the workpiece beneath the anode.

14. The apparatus of claim 12, wherein the one or more porous chamber dividers form the heated screen.

15. An apparatus for cleaning or coating a workpiece having an electrically conducting surface to be treated, the apparatus comprising:

(i) at least two opposed anode assemblies suitably disposed with respect to the surface to be treated, thereby forming a working gap between each anode assembly and the surface, (ii) means for sealing each working gap to form a sealed treatment zone between the anode assemblies, each anode assembly comprising an anode which is in communication with a chamber adapted to receive an electrically conductive medium;

means for supplying the electrically conductive medium to the chamber, and means for converting the electrically conductive medium into a foam;

(iii) means for moving the workpiece through the treatment zone;

(iv) means for opening and closing the treatment zone; and (v) means for controlling supply and removal of foam from the treatment zone so that the treatment zone is filled with foam during treatment.

16. An apparatus as claimed in claim 15, further including one or more seals for sealing the treatment zone.

17. An apparatus as claimed in claim 16, wherein the treatment zone is provided with at least one inlet for delivering the foam into the treatment zone and at least one outlet for removal of the foam therefrom.

18. An apparatus as claimed in claim 17, wherein the apparatus is provided with one or more vents, at least some of the one or more vents serving multi-functionally as a conduit for reaction byproducts, as an inlet for delivering the foam, or as an outlet for removal of the foam from the treatment zone.

* * * * *